US005392977A

United States Patent [19]

Kato

[11] Patent Number: 5,392,977

[45] Date of Patent: Feb. 28, 1995

[54] COIL MATERIAL SUPPLY APPARATUS FOR AN INTERMITTENT FEED DEVICE

[75] Inventor: Heizaburo Kato, Shizuoka, Japan

[73] Assignee: Sankyo Seisakusho Co., Tokyo, Japan

[21] Appl. No.: 149,464

[22] Filed: Nov. 9, 1993

[51] Int. Cl.[6] ..... B65H 20/32

[52] U.S. Cl. ..... 226/118; 226/45; 226/42; 72/8

[58] Field of Search ..... 226/118, 44, 45, 113, 226/24, 42; 100/216; 72/28, 8, 17

[56] References Cited

U.S. PATENT DOCUMENTS

| | | | |
|---|---|---|---|
| 3,762,198 | 10/1973 | Bair | 72/28 |
| 4,294,170 | 10/1981 | Takahashi | 100/216 |
| 4,384,665 | 5/1983 | Waddington | 226/42 |
| 4,464,916 | 8/1984 | Grew et al. | 72/17 |
| 4,561,581 | 12/1985 | Kelly | 226/118 X |

FOREIGN PATENT DOCUMENTS

| | | | |
|---|---|---|---|
| 0157388 | 12/1979 | Japan | 100/216 |
| 0092858 | 5/1984 | Japan | 226/45 |

*Primary Examiner*—Andrew M. Falik
*Attorney, Agent, or Firm*—Darby & Darby

[57] ABSTRACT

A coil material supply apparatus is provided between an uncoiler for unwinding a coil material (or a leveler for flattening the unwound coil material) and an intermittent feed device of a mechanical press. This apparatus includes a pair of feed rollers for feeding the coil material upwardly, a servo motor for driving the feed rollers, position sensors for detecting the amount of a loop of the coil material, and a controller responsive to a detection signal from the position sensors for controlling the rotation of the servomotor to control the loop to an optimum amount. With this apparatus, the fluttering of the coil material is reduced even when a high-speed operation is effected, and the load on the intermittent feed device is reduced, and the length of the pressing line or length of coil material feeding path can be reduced.

2 Claims, 2 Drawing Sheets

COIL MATERIAL SUPPLY APPARATUS FOR AN INTERMITTENT FEED DEVICE

BACKGROUND OF THE INVENTION

This invention relates to a coil material supply apparatus for supplying a coil material to an intermittent feed device of a mechanical press (pressing machine) in a pressing line.

With a high-speed pressing operation, the time used for intermittently feeding a coil material has become short, and the coil material is repeatedly fed and stopped in such a short time. As a result, the coil material vibrates by an exciting force exerted thereon, so that a wavy phenomenon called "fluttering" occurs. When such fluttering of the coil material occurs, not only an excessive burden or load is imposed on a feed device, but also the coil material is bent or damaged. To prevent this, it has been proposed to provide a buffer section called a "looper".

FIG. 2 shows a U-shaped looper, and that portion of a coil material 1 lying between an uncoiler 2 for unwinding the coil material 1 and an intermittent feed device 4 of a mechanical press 3 has a U-shaped buffer section. FIG. 3 shows an S-shaped looper, and that portion of a coil material 1 lying between an uncoiler 2 for unwinding the coil material 1 and an intermittent feed device 4 of a mechanical press 3 has an S-shaped buffer section.

With such conventional U-shaped looper or S-shaped looper, the fluttering of the coil material is reduced as compared with the case where no buffer section is provided; however, the fluttering still occurs when the operation is carried out at high speed, and therefore the increase of the operation speed has been limited, so that the ability of the press could not fully be utilized. Moreover, the looper itself has no drive source, and therefore the feed of the coil material depends on a pulling force from the intermittent device, or a pushing force from a leveler for flatting the coil material unwound from the uncoiler. Accordingly, the resistance is increased because of such pulling force and pushing force, so that the ability of the intermittent feed device or the leveler to supply the coil material has been lowered. A further problem is that since the length of the buffer section needs to be relatively large, the length of the pressing line has been increased.

SUMMARY OF THE INVENTION

With the above problems of the prior art in view, it is an object of this invention to provide a coil material supply apparatus which reduces the fluttering of a coil material even when a high-speed operation is effected, and also alleviates the load on an intermittent feed device and other devices, and can reduce the length of a pressing line.

According to the present invention, there is provided apparatus for supplying a coil material to an intermittent feed device of a mechanical press, comprising:

a pair of feed rollers disposed in the vicinity of the intermittent feed device for feeding the coil material upwardly toward the intermittent feed device in such a manner that the coil material has a loop;.

a servo motor for rotating the pair of feed rollers;

position sensor means disposed above the pair of feed rollers for detecting the amount of the loop of the coil material to output a detection signal representative of the loop amount; and a controller responsive to the detection signal for controlling the operation of the servomotor to control the amount of feed of the coil material by the pair of feed rollers.

With this coil material supply device, the position sensor means detect the amount of the loop of the coil material, and the coil material is fed toward the intermittent feed device while maintaining the optimum loop amount. Therefore, the fluttering of the coil material is kept to a minimum, thereby enabling a high-speed operation, and also the load on the intermittent feed device is reduced to enhance the ability to supply the coil material, and the amount of the loop can be decreased, so that the length of the pressing line can be reduced.

DESCRIPTION OF THE PREFERRED EMBODIMENT

Figure 1:
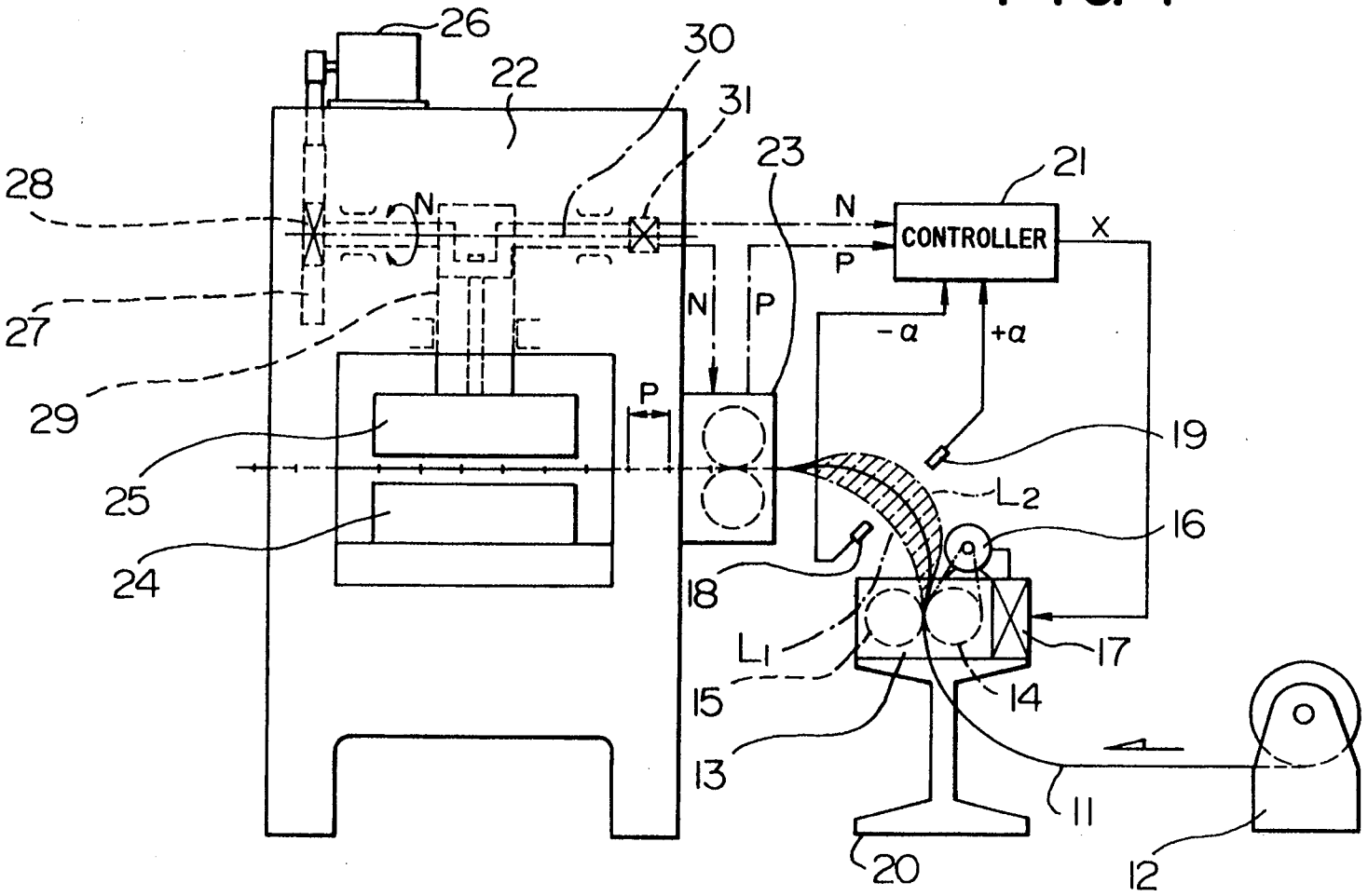
FIG. 1 is a schematic view showing a pressing line incorporating one preferred embodiment of a coil material supply apparatus of the present invention.
Figure 2:
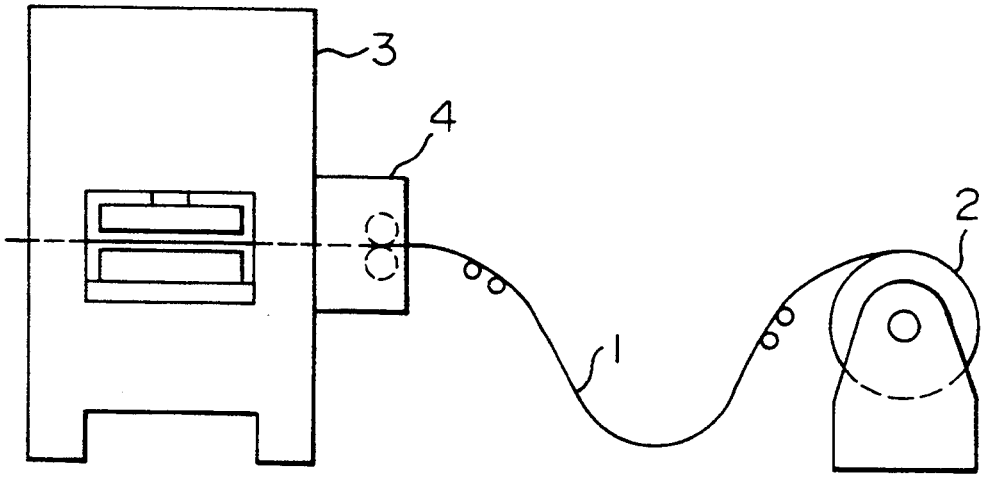
FIG. 2 PRIOR ART
FIG. 2 is a schematic view of a conventional pressing line, showing a U-shaped looper.
Figure 3:
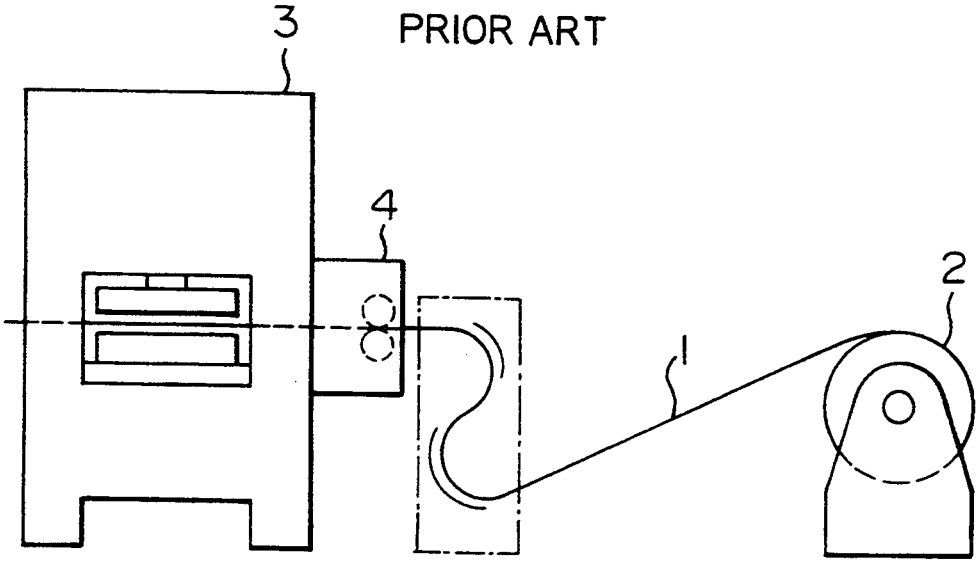
FIG. 3 PRIOR ART
FIG. 3 is a schematic view of another conventional pressing line, showing an S-shaped looper.

FIG. 1 shows one preferred embodiment of the present invention. A coil material 11 is unwound by an uncoiler 12. A coil material supply apparatus 13 provided in accordance with the present invention comprises a pair of feed rollers 14 and 15 for feeding the coil material 11, a servo motor 16 for driving or rotating the feed roller (drive roller) 14, a driver 17 for driving the servomotor 16, and position sensors 18 and 19 for detecting the amount of a loop of the coil material 11. These constituent members and devices are mounted on a stand 20. A leveler for flattening the coil material 11 unwound from° the uncoiler 12 may be provided between the uncoiler 12 and the coil material supply apparatus 13. The driver 17 and position sensors 18 and 19 of the coil material supply apparatus 13 are connected to a controller 21. The controller 21 also controls a mechanical press 22 and an intermittent feed device 23. The intermittent feed device 23 is mounted on one side surface of the mechanical press 22, and is so positioned as to horizontally feed the coil material 11 into a space between upper and lower dies 25 and 24 at the time of the pressing operation. In this embodiment, although the intermittent feed device 23 comprises a roll-type feed device, it may comprise a gripper-type feed device. The mechanical press 22 comprises a motor (drive means) 26, a flywheel 27 for storing the rotational force of the motor 26, a clutch brake 28 for taking out the rotational force of the flywheel 27, and a crankshaft 30 for converting the rotational force of the flywheel 27 into a linear reciprocal motion of the upper die 25, and a rotational angle detection device 31 for detecting the angle of rotation of the crankshaft 30.

The operation of the above embodiment will now be described. The direction of a reel of the uncoiler 12 is so determined that the coil material 11 is unwound from a lower portion of this reel. The coil material supply device 13 is disposed at a position spaced from the intermittent feed device 23, and the height of the stand 20 is so adjusted that the pair of feed rollers 14 and 15 are disposed at a level below the intermittent feed device 23, and that a predetermined loop can be obtained at the coil material 11 at a region between the coil material supply device 13 and the intermittent feed device 23. The lower position sensor 18 is disposed on a lower side of the loop of the coil material 11 so as to detect a minimum loop length $L_1$ of the coil material 11, and the upper position sensor 19 is disposed on an upper side of the loop as to detect a maximum loop length $L_2$ of the coil material 11. Each of the position sensors 18 and 19 is angularly movably mounted on the stand 20 through a lever, and by pivotally moving the lever, the position of each of the position sensors 18 and 19 can be adjusted. In this embodiment, although each of the position sensors 18 and 19 comprises a proximity switch, it may comprise any other suitable position sensor.

Here, the crankshaft 30 of the mechanical press 22 is operated at a rotational angle N, and the intermittent feed device 23 is operated in synchronism with the crankshaft 30, and the coil material 11 is intermittently fed at a feed pitch P per revolution. Therefore, the coil material 11 is fed an amount or length ($N \times P$) per unit time. Namely, the coil material supply device 13 need only to feed the coil material 11 by a length ($N \times P$) per unit time. The angle X of rotation of the drive feed roller 14 is expressed by the following formula:

$$X = \frac{N \times P}{d\pi} \pm \alpha$$

where d represents the diameter of the drive feed roller 14.

The condition of the loop between the intermittent feed device 23 and the coil material supply device 13 must be maintained in such a manner that the loop length is in the range of between the minimum loop length $L_1$ and the maximum loop length $L_2$, and that the relation, $L_2 - L_1 > P$, is maintained. Therefore, this loop condition is monitored by the position sensors 18 and 19. When the loop of the coil material 11 becomes small, so that the minimum loop length $L_1$ is detected by the position sensor 18, this detection signal is sent to the controller 21, and the controller 21 controls the operation of the servomotor 16 through the driver 17 to increase the rotational angle X of the drive feed roller 14 by an amount of $\alpha$ to increase the amount of feed of the coil material 11, thereby bringing the loop into a proper loop length $L_3$. In contrast, when the loop becomes large, so that the maximum loop length $L_2$ is detected by the position sensor 19, this detection signal is sent to the controller 21, and the controller 21 controls the operation of the servomotor 16 through the driver 17 to decrease the rotational angle X of the drive feed roller 14 by an amount of $\alpha$ to decrease the amount of feed of the coil material 11, thereby bringing the loop into the proper loop length $L_3$. The minimum loop length $L_1$, the maximum loop length $L_2$ and the proper loop length $L_3$ are determined by the shape and physical properties of the coil material 11 to be used, the distance between the coil material supply device 13 and the intermittent feed device 23, and so on.

As described above, in this embodiment, the minimum and maximum loop lengths $L_1$ and $L_2$ are monitored by the position sensors 18 and 19, respectively, and the coil material 11 is supplied from the coil material supply device 13 to the intermittent feed device 23, while controlling the amount of feed of the coil material 11 by the feed rollers 14 and 15 to the optimum level under the control of the controller 21. Therefore, a high-speed operation can be achieved with a less fluttering and also with a less load on the intermittent feed device 23.

As described above, in the present invention, the position sensors detect the amount of the loop of the coil material, and the coil material is supplied to the intermittent feed device while maintaining the optimum loop configuration. Therefore, the high-speed operation with a less fluttering is achieved, and also the load on the intermittent feed device is reduced, thereby enhancing the supply ability. And besides, since the amount of the loop can be decreased, the length of the pressing line can be reduced.

What is claimed is:

1. An apparatus for supplying a coil material, to a mechanical press, comprising:

an intermittent feed device;

a pair of feed rollers disposed in the vicinity of the intermittent feed device for feeding the coil material upwardly toward the intermittent feed device in such a manner that the coil material has a loop;

a servo motor for rotating said pair of feed rollers;

position sensor means disposed above said pair of feed rollers for detecting the amount of said loop of the coil material to output a detection signal representative of said loop amount; and a controller responsive to said detection signal for controlling the operation of said servomotor to control the amount of feed of the coil material by said pair of feed rollers.

2. The apparatus of claim 1, wherein said position sensor means comprises an upper sensor disposed on an upper side of said loop of the coil material for detecting a maximum length of said loop to output a first detection signal, and a lower sensor disposed on a lower side of said loop of the coil material for detecting a minimum length of said loop to output a second detection signal, wherein said controller is responsive to said first detection signal for controlling the operation of said servomotor to decrease the amount of feed of the coil material by said feed rollers, and also said controller is responsive to said second detection signal for controlling the operation of said servomotor to increase the amount of feed of the coil material by said feed rollers.

* * * * *